US005771813A

United States Patent [19]

Jackson

[11] Patent Number: 5,771,813

[45] Date of Patent: Jun. 30, 1998

[54] UTILITY TABLE FOR REMOVING, STORING AND INSTALLING VEHICLE SEAT

[76] Inventor: Prentice R. Jackson, 360 Cypress Creek Cir., Oldsmar, Fla. 34677

[21] Appl. No.: 773,388

[22] Filed: Dec. 26, 1996

[51] Int. Cl.[6] ..... A47B 83/00

[52] U.S. Cl. ..... 108/50.011; 297/217.7

[58] Field of Search ..... 108/50, 127, 90, 108/50.011, 179; 297/217.7

[56] References Cited

U.S. PATENT DOCUMENTS 1,349,710 8/1920 Beeson ..... 211/10

3,123,935 3/1964 Williams ..... 108/50

3,394,963 7/1968 Antonioli ..... 297/217.7

*Primary Examiner*—Peter M. Cuomo

*Assistant Examiner*—Gerald A. Anderson

*Attorney, Agent, or Firm*—Wolf, Greenfield & Sacks, P.C.

[57] ABSTRACT

A utility table used for removing a rear seat of a van or sports-utility vehicle. The table top is made with a front edge that conforms rather precisely with the rear edge of the vehicle floor, and its legs support the table top at the height of the floor so that the table top forms a continuation of the vehicle floor and the rear seat of the vehicle can be rolled or slid directly onto the table. A recess in the rear edge of the table top allows the person removing the seat to stand close to the rear of the vehicle and easily reach across the table top and grasp the rear seat to pull it onto the table.

12 Claims, 5 Drawing Sheets

UTILITY TABLE FOR REMOVING, STORING AND INSTALLING VEHICLE SEAT

INTRODUCTION

This invention is a device for assisting in the removal, storage and installation of a vehicle seat and more particularly is a special use table specifically designed to enable one person without assistance to remove the back seats from a van-type vehicle and to later reinstall them in the vehicle. The table also functions as a convenient storage station off the ground for a removed seat so that it will not become soiled or damaged.

Vans and sports-utility vehicles have become very popular because of their versatility and frequently serve particularly young families as the all purpose family automobile. Not only do they have the capacity to carry many passengers, but they can also carry larger objects such as furniture, bicycles and other household items when the rear seat or seats is removed. Heretofore, however, no convenient means was available to remove the rear seats of such vehicles. Although the rear seat or seats can be removed through the hatch-type door of vans and sport-utility vehicles, two people are required to do so.

The primary object of the present invention is to provide a convenient and easy to use table that enables one person to remove a rear seat of the vehicle, to store it, and to reinstall the seat in the vehicle when needed.

Another important object of the invention is to provide a special table that enables the rear seat or seats of a van or the rear seat of a sport-utility vehicle to be removed from the vehicle without lifting or carrying the seat.

Yet another object of this invention is to provide a special purpose table for removing and installing vehicle rear seats, which can be stored in a small space when not in use.

To accomplish these and other objects, the special use table of this invention has a table top of particular shape and height so that it can be positioned to form a continuation of the floor of the vehicle whose seat is to be removed, with essentially no gap between the table top and the floor so that a rear seat can easily be dragged or rolled onto the table from the vehicle floor through the rear hatch door. While the table is deep enough to carry the seat, the table top has a recess in one edge so that the person removing the seat can stand very close to the vehicle floor and easily reach across the table top and grasp the seat. Stops are provided in the table to anchor the seat in position and prevent it from sliding off the table.

These and other objects and features of the invention will be better understood and appreciated from the accompanying description and drawings of the preferred embodiment thereof.

BRIEF FIGURE DESCRIPTION

DETAILED DESCRIPTION

Figure 1:
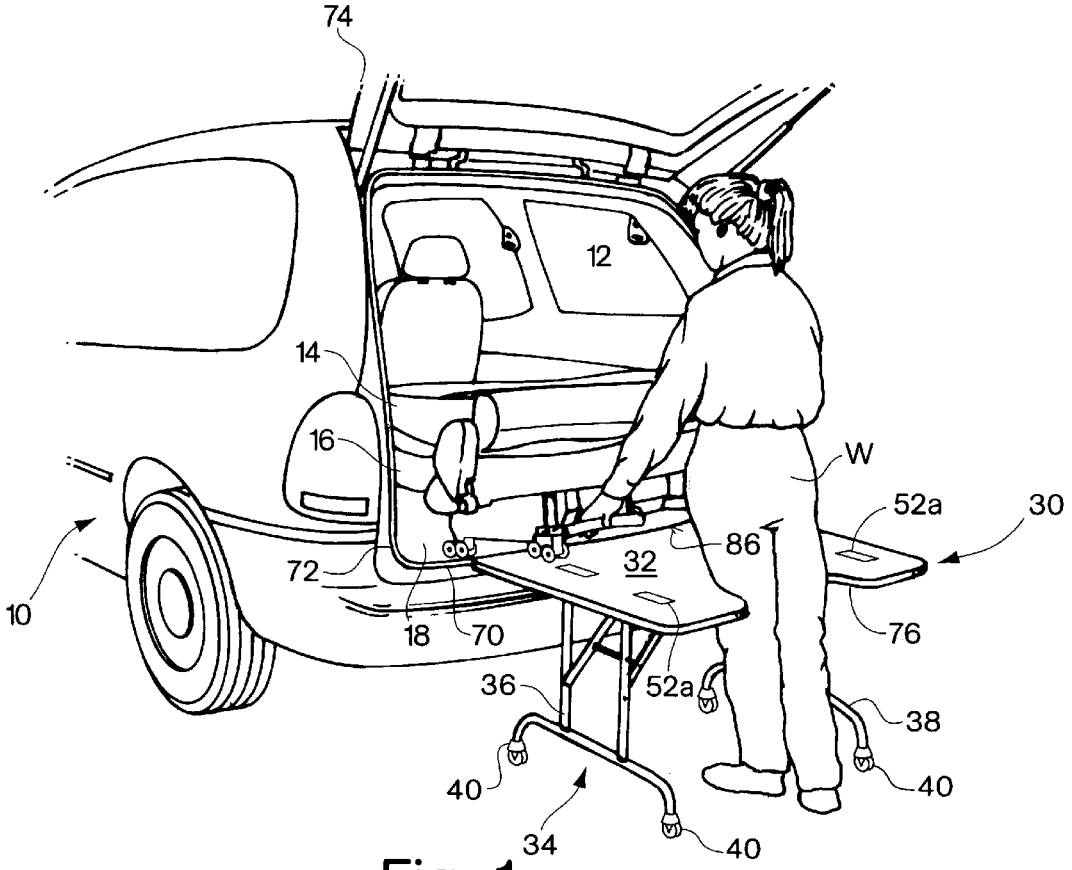
FIG. 1 is a perspective view of a table constructed in accordance with this invention and shown disposed against the rear of a van-type vehicle and further showing how the table is used when removing and installing a rear bench seat of the van.
Figure 2:
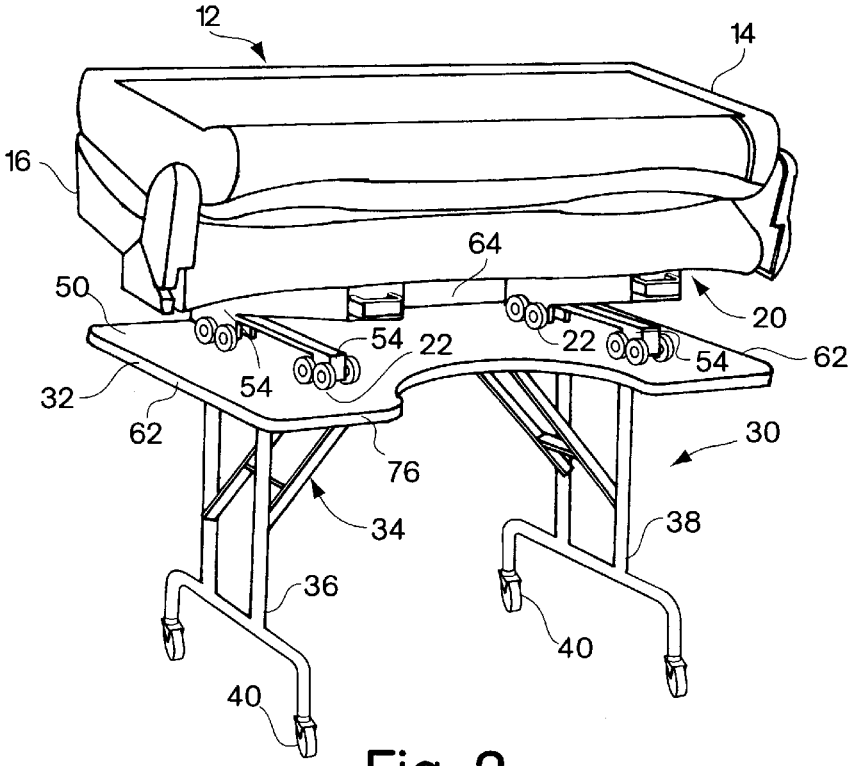
FIG. 2 is a perspective view of the table shown in FIG. 1 with the rear bench seat of the van disposed on the table.

In FIG. 1, a van-type vehicle 10 is shown with its rear bench seat 12 collapsed so that its back 14 rests horizontally on the seat 16. In the van illustrated, the rear seat 12 rests on the vehicle floor 18, and the seat 12 includes a base 20 having rollers 22 that facilitate moving the seat in and out of the van. The van and its seat structure is of conventional manufacture well-known in the automotive industry. The floor of the van has locking devices (not shown) for securing the seat 12 in its operative position on the floor 18 to comply with the safety requirements established in the automotive industry.

Figure 6:
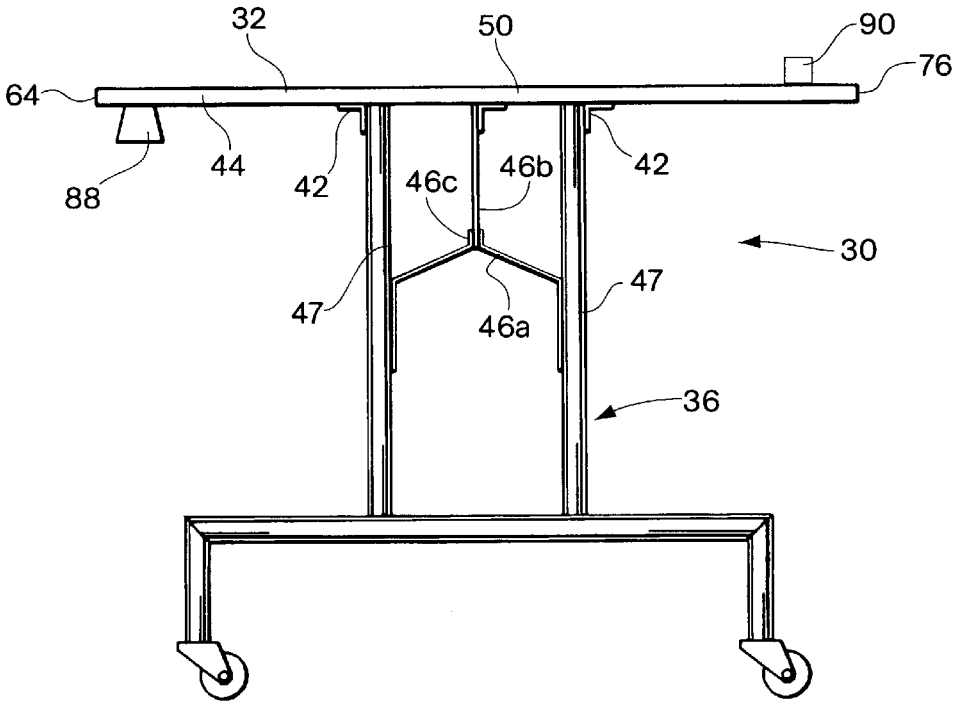

The utility table 30 also shown in FIG. 1 embodies the present invention and is specifically designed to enable one person without assistance to remove the rear seat or seats 12 from the van whenever desired so as to increase the van's capacity for transporting large objects, etc. The table 30 includes a top 32 and a leg assembly 34. The leg assembly 34 shown is of conventional construction and includes two separate sections 36 and 38 each having casters 40 at the bottom, which enable the table to be moved easily from one location to another. Preferably the leg sections 36 and 38 are collapsible so that the table may be stored conveniently in a small space anywhere, including the back of the van behind the rear seat. For that purpose, the upper end of each leg section 36 and 38 is pivotally secured to brackets 42 attached to the bottom surface 44 of the table top, and foldable braces 46 are pivotally attached at their ends between the leg sections and the table top bottom surface. Each brace is made up of two links 46*a* and 46*b* joined by a pivot 46*c*. The lower link 46*a* includes a pair of arms, one extending to each leg post 47 in its leg section as shown in FIG. 6. Additional brackets 48 are attached to the lower surface 44 of the table top to secure the braces 46. Because the leg assembly shown is of a well-known construction widely used for picnic tables, utility tables, etc., they need not be described in greater detail.

The table top 32 has an upper surface 50 onto which the rear seat 12 of the vehicle may be rolled when removed from the rear of the vehicle. To secure the seat firmly on the top 32, recesses 52 that serve as anchors are provided in the upper surface which may or may not extend through the table top. The recesses are sized to receive the latch hooks 80 mounted on the base 20 so that when the rear seat is brought onto the table top and the rollers 22 are disposed on the surface 50, the rear seat will be held securely on the table and will not roll off even when the table is moved about.

Figure 7:
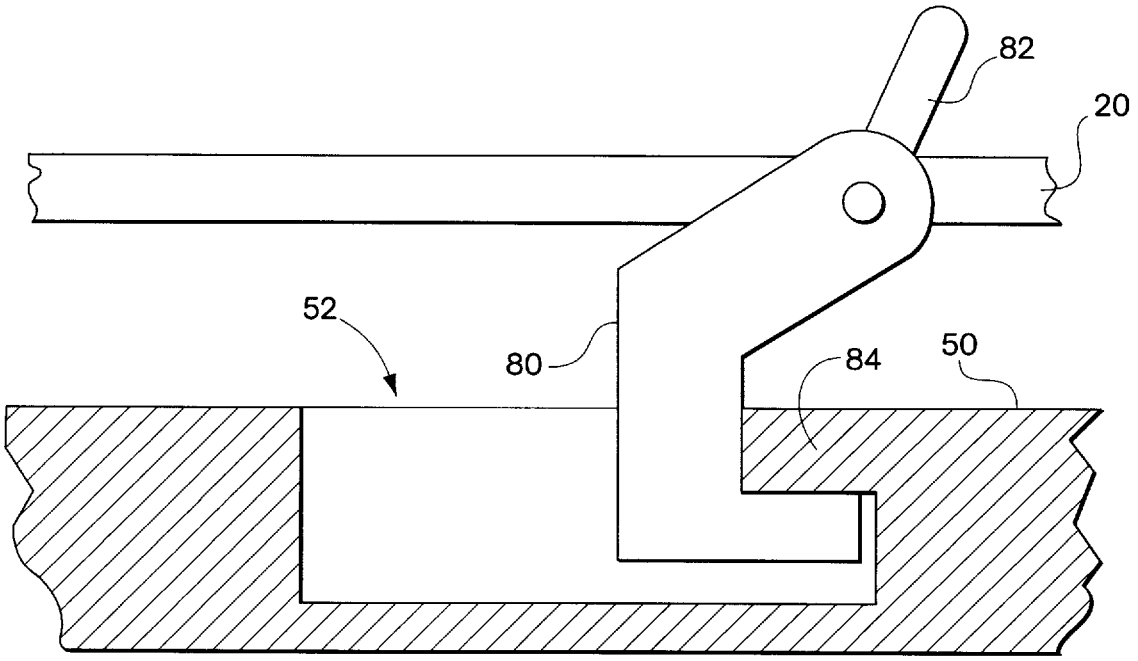
FIG. 7 is a diagrammatic view showing the manner in which the seat may be anchored on the table.

In FIG. 7 a typical arrangement for anchoring the seat is diagrammatically shown. The latch hook 80 is pivotally mounted on the seat frame 20 and has a handle 82 by which the latch hook may be pivoted to the locking position in the recess 52 engaging the flange 84 or withdrawn from the recess to free the seat. The same latch hook may be used to anchor the seat on the floor of the vehicle when placed in the proper operative position. It should be appreciated that four such latching arrangements may be provided on the seat and table so that the seat may be securely anchored in place.

The table top 32 has a specially formed peripheral edge 60 comprised of side portions 62, front portion 64 and rear portions 66. As noted in FIGS. 3 and 4, the front edge portion 64 is slightly bowed. This configuration is shown in FIG. 1 to conform precisely to the curvature of the rear edge 70 of the floor 18 of the van. A sealing gasket 72 is shown provided along the edge 70 of vehicle the floor so as to seal the rear of the van when the hatch door 74 is closed. Because the edge portion 64 of the table top 32 conforms to the edge 70 of floor 18 when the hatch 74 is open and the eight of the leg assembly 30 is chosen to position the table top in the plane of floor, the table top 32 essentially forms a gap-free continuation of the floor. Therefor, the rear seat 12 when detached from its anchors (not shown) in the vehicle floor 18 van can be readily rolled along the floor 18 and onto to the table upper surface 50.

Figure 5:
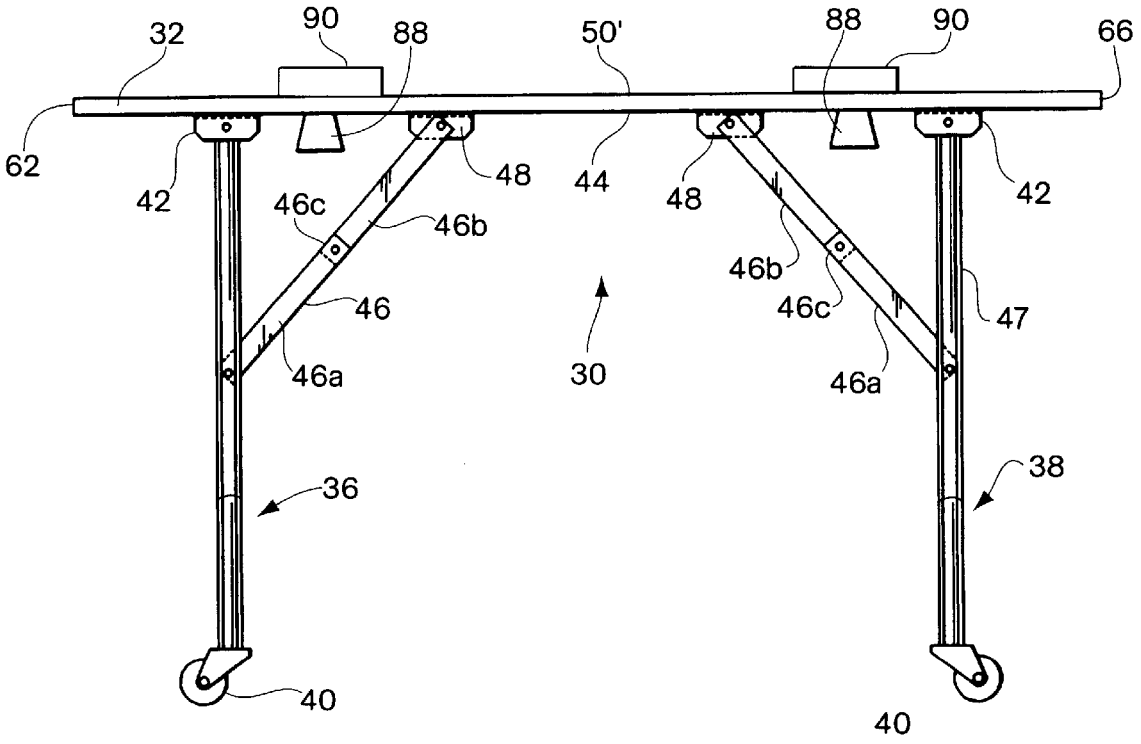
FIGS. 5 and 6 are rear and left side elevations of the table shown in FIG. 3.

A mark 86 may be provided on the table top 32 at the center of the front edge portion 64 so as to assist in properly aligning the table with the floor of the vehicle. The hatch door lock (not shown) on the floor of the vehicle may serve as the center line reference for the table marking 86. Bumpers 88 made of rubber or other suitable material may also be provided on the bottom surface 44 of the table top 32 at the front edge 64 (see FIGS. 5 and 6) to prevent the table top from overriding the vehicle floor when the table is wheeled into position.

Figure 3:
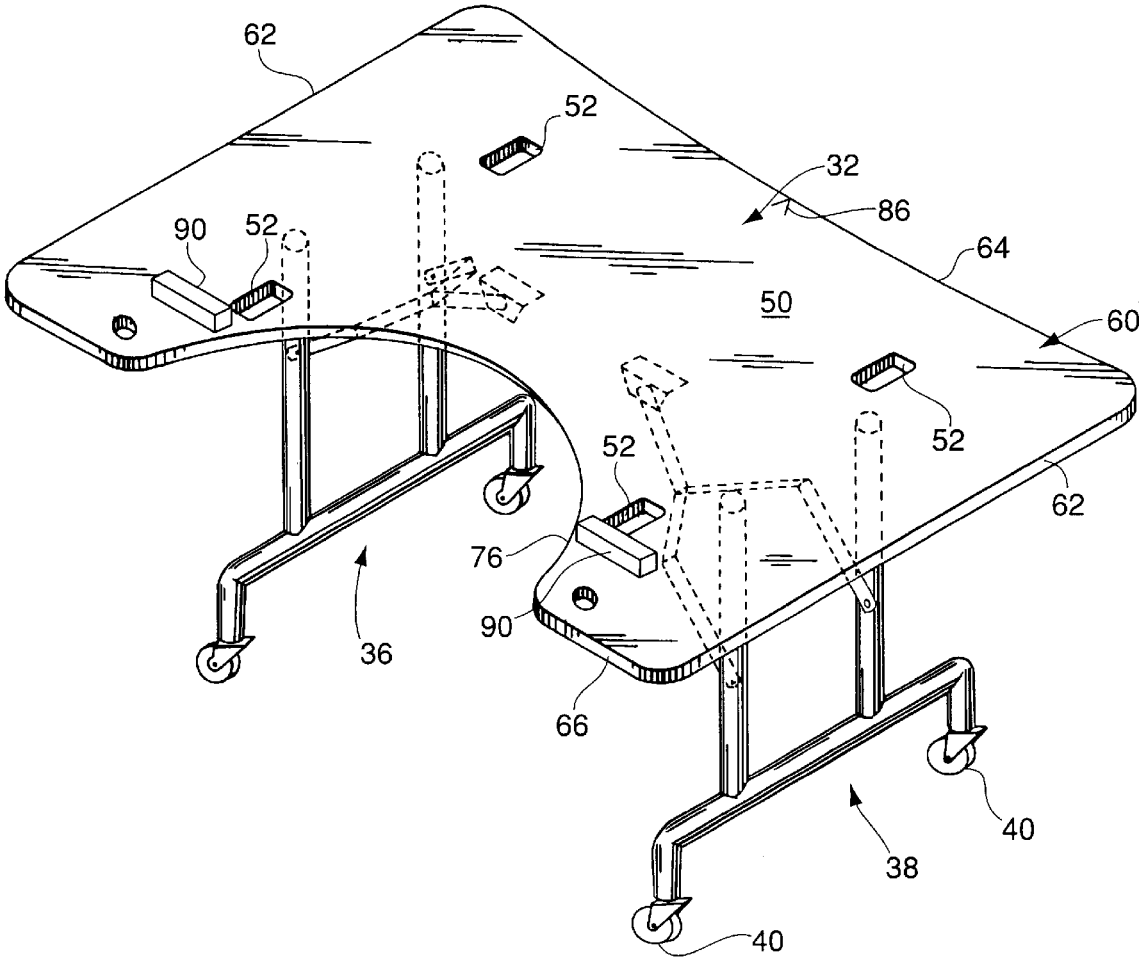
FIG. 3 is a perspective view of the table shown in FIGS. 1 and 2.
Figure 4:
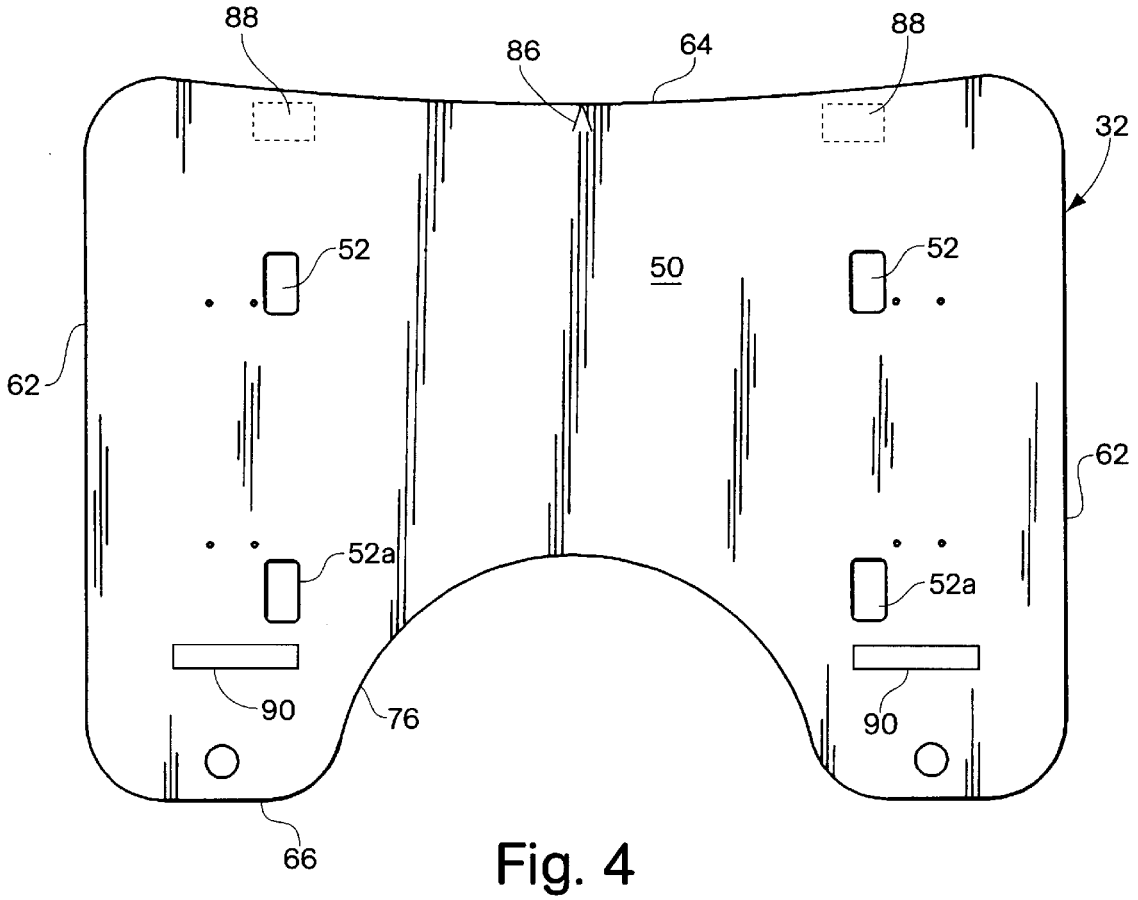
FIG. 4 is a plan view of the top surface of the table shown in FIG. 3.

The rear edge portion 66 of the table top 32 is provided with a large recess 76 that substantially reduces the depth of the table from front to rear edge as is evident particularly in FIGS. 3 and 4. In FIG. 1, the function of the recess 76 is clearly shown. In that figure, a woman is shown standing on the ground and positioned against the edge 66 of the table within the recess 76. Because of the recess, the woman is within comfortable reaching distance of the rear seat base 20 so that she can easily pull the rear seat 12 onto the upper surface 50 of the table top. In the absence of the recess or cut out 76, it would be necessary for the woman to bend over and reach across the entire depth of the table to grasp the seat. That body position while pulling on the rear seat could result in back injury. It will be noted that the recess 76 extends into the table top 50 forward of the rear anchor slots 52*a* which receive the latch hooks 80 on the base 20 of the seat, but the recess 76 does not extend into the area occupied by the rollers 22, which would limit their ability to stabilize the seat on the table.

Preferably additional stops 90 in the form of flanges are provided on the upper surface 50 of the table top 32 as shown in FIGS. 3 and 4. The stops 90 are positioned rearwardly of the rear pair of recesses 52*a* so as to prevent the seat 12 from rolling over the rear edge 66 of the table as the seat is pulled onto the table top 32.

From the foregoing it will be appreciated that the table of the present invention provides a very convenient means for assisting in the removal and installation of the rear seat of the vehicle. The device of course may be used to remove any removable seat from the vehicle through the hatch door and is particularly suitable for removing band seats behind the front seat of a van or sports-utility vehicle. It allows one person to do the job without assistance from others. The table also provides a convenient storage platform off the ground while the seat is out of the vehicle so that it will not become soiled or broken. Moreover, the table can be stored when not in use compactly in a small space such as the side of a garage or in the vehicle itself behind the rear seat 12 or on the floor 18.

Because many modifications may be made of the present invention without departing from its spirit, it is not intended that its breadth be limited to the single embodiment illustrated. Rather, appended claims and their equivalents.

I claim:

1. A table for conveying a seat to and from the floor of a van-type or sports-utility vehicle through a door of the vehicle, said seat being detachably connected to the floor of the vehicle in an operative position and having rollers for facilitating moving of the seat between an operative position on the vehicle floor and the door of the vehicle, comprising a table top having upper and lower surfaces and front and rear edges, a leg assembly attached to the lower surface of the table top for supporting the top with its upper surface essentially co-planar with the floor of the vehicle on which the seat rests, said leg assembly having casters for rolling the table toward and away from the vehicle, said front edge of the table top conforming in shape to a edge of a floor of a vehicle at a door so that the table can be positioned immediately adjacent the floor, and the seat can be rolled onto the upper surface of the table top, and anchoring devices in the upper surface for engaging the seat to hold the seat in a fixed position on the table top.

2. A table as defined in claim 1 wherein the anchors for engaging the seats are recesses in the upper surface for receiving latches attached to the seat.

3. A table as defined in claim 1 wherein the rear edge of the top has a recess in which a person removing or installing the vehicle seat can stand close to the front edge of the table top and engage the seat when the seat is disposed in the operative position.

4. A table as defined in claim 3 wherein the anchors for engaging the seat are recesses in the upper surface for receiving latches attached to the seats.

5. A table as defined in claim 1 wherein the leg assembly is collapsible.

6. A table for removing and installing a seat in a vehicle wherein the vehicle has a floor on which the seat is secured in an operative position and a door provides access to the floor and through which the seat may be removed from and installed in the operative position in the vehicle, said table comprising a table top having a peripheral edge and wherein the edge of the table top has a portion shaped to match the edge of the floor of the vehicle adjacent to the door for enabling the table top to be placed closely adjacent the floor permitting the seat to be transferred between the table top and the vehicle floor, a leg assembly attached to the table top for supporting the table top essentially coplanar with the vehicle floor so that the seat may be moved on the floor, through the door, and onto the table top from the operative position, and a recess in the table top extending toward the edge for allowing a person standing in the recess to reach across the table top and grasp the seat in the operative position.

7. A table as defined in claim 6 wherein the leg assembly is collapsible.

8. A table as defined in claim 6 wherein means are provided in the table for retaining the seat in a preselected position on the table top.

9. A table as defined in claim 8 wherein the leg assembly is collapsible.

10. A table as defined in claim 6 wherein the legs have rollers for moving the table toward and away from the vehicle.

11. A table as defined in claim 10 wherein means are provided in the table for retaining the seat in a preselected position on the table top.

12. A table as defined in claim 6 wherein the edge of the table top has another portion that has a recess in which a person transferring the seat between the vehicle floor and table top may stand close to the edge of the floor.

* * * * *